US007028597B2

(12) United States Patent
Belmann et al.

(10) Patent No.: US 7,028,597 B2
(45) Date of Patent: Apr. 18, 2006

(54) PERFORATING APPARATUS WITH FINE SETTING

(75) Inventors: Markus Belmann, Kornwestheim/Pattonville (DE); Hatto Hechler, Stuttgart (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/859,834

(22) Filed: May 17, 2001

(65) Prior Publication Data

US 2001/0042425 A1 Nov. 22, 2001

(30) Foreign Application Priority Data

May 17, 2000 (DE) ..... 100 23 994

(51) Int. Cl.
*B26D 5/08* (2006.01)
*B26D 1/18* (2006.01)
*B26D 7/28* (2006.01)

(52) U.S. Cl. ..... 83/527; 83/487; 83/490; 83/508.2; 83/639.1; 83/660

(58) Field of Classification Search ..... 83/698.31–699.51, 678, 695, 527, 530, 503, 83/506, 507, 344, 639.1, 639.7, 485, 487, 83/660, 488, 508.1, 508.2, 490, 881
See application file for complete search history.

(56) References Cited

U.S. PATENT DOCUMENTS 3,182,535 A * 5/1965 Quakenbush ..... 83/881
3,380,330 A 4/1968 Gilmore
3,718,064 A * 2/1973 Abarotin et al. ..... 83/502
3,892,156 A 7/1975 Johnstone
4,210,052 A * 7/1980 Fisher ..... 83/881
4,226,153 A * 10/1980 Insolio ..... 83/881
4,228,711 A * 10/1980 Insolio ..... 83/881
4,392,404 A * 7/1983 Schwarzenberg et al. ..... 83/886
5,247,865 A * 9/1993 Kroger et al. ..... 83/482

FOREIGN PATENT DOCUMENTS

| | | | |
|---|---|---|---|
| DE | 2333662 | A1 | 1/1975 |
| DE | 2451491 | | 8/1975 |
| DE | 3439199 | C1 | 1/1986 |
| DE | 3819264 | A1 | 12/1988 |
| DE | G8909371.2 | | 11/1989 |
| DE | 29712149 | U1 | 11/1998 |
| EP | 0 562 454 | A1 | 9/1993 |
| WO | 99/02315 | | 1/1999 |

OTHER PUBLICATIONS

The American College Heritage Dictionary, 1982, Houghton Mifflin Company, Second College Edition, p. 782.*

* cited by examiner

*Primary Examiner*—Kenneth E. Peterson
*Assistant Examiner*—Isaac Hamilton
(74) *Attorney, Agent, or Firm*—Laurence A. Greenberg; Werner H. Stemer; Ralph E. Locher

(57) ABSTRACT

In a perforating apparatus which has a holder to which a perforating blade can be fastened, the perforation is produced via the movement of a piston by the piston pressing against an air cushion, which in turn transmits this pressure to a perforating piston which presses the perforating blade downward. A positioning device which directly varies the position of the piston unit relative to the housing surface is provided for the zero setting of the piston.

5 Claims, 2 Drawing Sheets

PERFORATING APPARATUS WITH FINE SETTING

BACKGROUND OF THE INVENTION

Field of the Invention

The invention relates to a perforating apparatus having a movable device to which a holder having a perforating means can be attached and to a piston unit for moving the unit.

German patent DE 34 391 99 C1, by way of example, discloses such a perforating apparatus. During the use of a perforating apparatus of the above-mentioned type, a sheet is guide below and past the perforating apparatus. By means of a perforating disk, which is rotatably mounted on a holder, a perforation is made in the paper sheet that is moving underneath or the sheet is cut. In that case, compressed air is admitted to a piston, and the piston is moved upward or downward as a result. The elements of the perforating apparatus are combined in a "perforating head", which is normally fastened to a crosspiece in a folding machine in order to permit the perforation of sheet material conveyed in the folding machine.

The adjustment of the perforating head has hitherto only been possible to a limited extent, since a vertical setting is possible only by changing the vertical position of the perforating head on the crosspiece.

During the perforation of sheet material, however, it is especially important to exactly adjust the penetration depth of the cutting or perforating blade, so that it is always possible to make the desired perforation or the desired cut. In particular when implementing types of perforation in which the perforating blade is only intended to partly penetrate into the sheet material running past underneath, for instance halfway into the sheet material, it is especially important to exactly adjust the penetration depth of the perforating blade into the sheet material. This becomes especially clear when it is taken into account that the thickness of the sheet is typically in the neighborhood of 0.1 mm. Since the length of travel can be controlled exactly during the lifting and lowering of the perforating head, the zero point, i.e. the initial position of the perforating blade before the lowering into the sheet material to be perforated, must accordingly be set exactly.

SUMMARY OF THE INVENTION

The object of the present invention is to provide a perforating apparatus which overcomes the above-noted deficiencies and disadvantages of the prior art devices and methods of this general kind, and which is enabled for accurate initial positioning of the cutting or perforating blade.

With the above and other objects in view there is provided, in accordance with the invention, a perforating apparatus, comprising:

a movable device configured to carry a holder for a perforating device;

a piston unit for moving the movable device; and a positioning device for setting an initial position of the piston unit attached to and acting directly on the piston unit.

In accordance with an added feature of the invention, the positioning device is formed with an external thread and an internal thread, a lead of the external thread being matched to a lead of the internal thread such that turning of the positioning device causes a movement of the piston unit smaller than a movement of the positioning device caused by the turning.

In accordance with an additional feature of the invention, the positioning device has a differential screw arranged between a fixed part and the piston unit. Preferably, the differential screw is formed with an external thread and an internal thread, the internal thread having a lead different from a lead of the external thread, and one of the threads is connected to the piston unit via a corresponding mating thread, and the other one of the threads is connected to a fixed part via a corresponding mating thread. Further, in a specific embodiment, the lead of the internal thread is smaller than the lead of the external thread, and the internal thread meshes with a thread formed on the piston unit.

In accordance with another feature of the invention, there are provided elastic elements disposed to establish a backlash-free connection between the external thread and the internal thread.

In accordance with a further feature of the invention, the differential screw and the piston unit are formed with a bore for receiving therein a screw having a screw head. In a specific embodiment, the bore in the differential screw is formed with a shoulder, and a spring mechanism supports the screw head of the screw on the shoulder in a direction to the piston unit. The spring mechanism, by way of example, is a disk spring assembly.

In accordance with again a further feature of the invention, a nut is connected to a housing of the perforating apparatus in a rotationally locked manner by a pin, and the differential screw has an external thread meshing in a thread of the nut. In a preferred embodiment, a round nut is arranged above the first-mentioned nut and acts on the nut via a corrugated spring assembly, for reducing a thread backlash between the nut and the differential screw.

With the above and other objects in view there is also provided, in accordance with the invention, a method of adjusting a perforating apparatus, which comprises:

providing a perforating apparatus with a movable device configured to attach thereto a holder for a perforating device, and a piston unit which can be moved from an initial position into an end position; and adjusting the initial position of the piston unit with a positioning device and thereby directly acting with the positioning device on the position of the piston unit.

In accordance with again an added feature of the invention, the positioning device is provided with an external thread and an internal thread, and the perforating apparatus is adjusted by turning the positioning device, whereby the positioning device acts on the piston unit.

In accordance with a concomitant feature of the invention, the positioning device is a differential screw having an internal thread and an external thread, a lead of the internal thread is smaller than a lead of the external thread, and the internal thread engages directly in the piston unit, and the adjusting step comprises turning the differential screw for setting the position of the piston unit.

The provision of a device which acts directly on a piston unit of the perforating apparatus in order to set this piston unit in its basic position has a large number of advantages. It is thus possible to exactly establish the initial position of the piston and consequently the initial position of the processing means, that is, in particular, the cutting or perforating blade, before the lowering into the sheet material to be perforated.

In addition, in the embodiment which is especially preferred according to the invention and in which a differential screw is used, there is the advantage that exact positioning is thus possible in an infinitely variable and very sensitive manner. The differential screw consists of two threads of different lead. The difference between the leads, which can be kept considerably smaller than the lead of an individual thread, establishes the setting travel per turn of the setting screw. In a special embodiment, the differential screw may be in direct contact with the piston of the perforating apparatus via an internal thread and furthermore has an external thread, the internal thread being smaller than the external thread.

Other features which are considered as characteristic for the invention are set forth in the appended claims.

Although the invention is illustrated and described herein as embodied in a perforating apparatus with fine setting, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
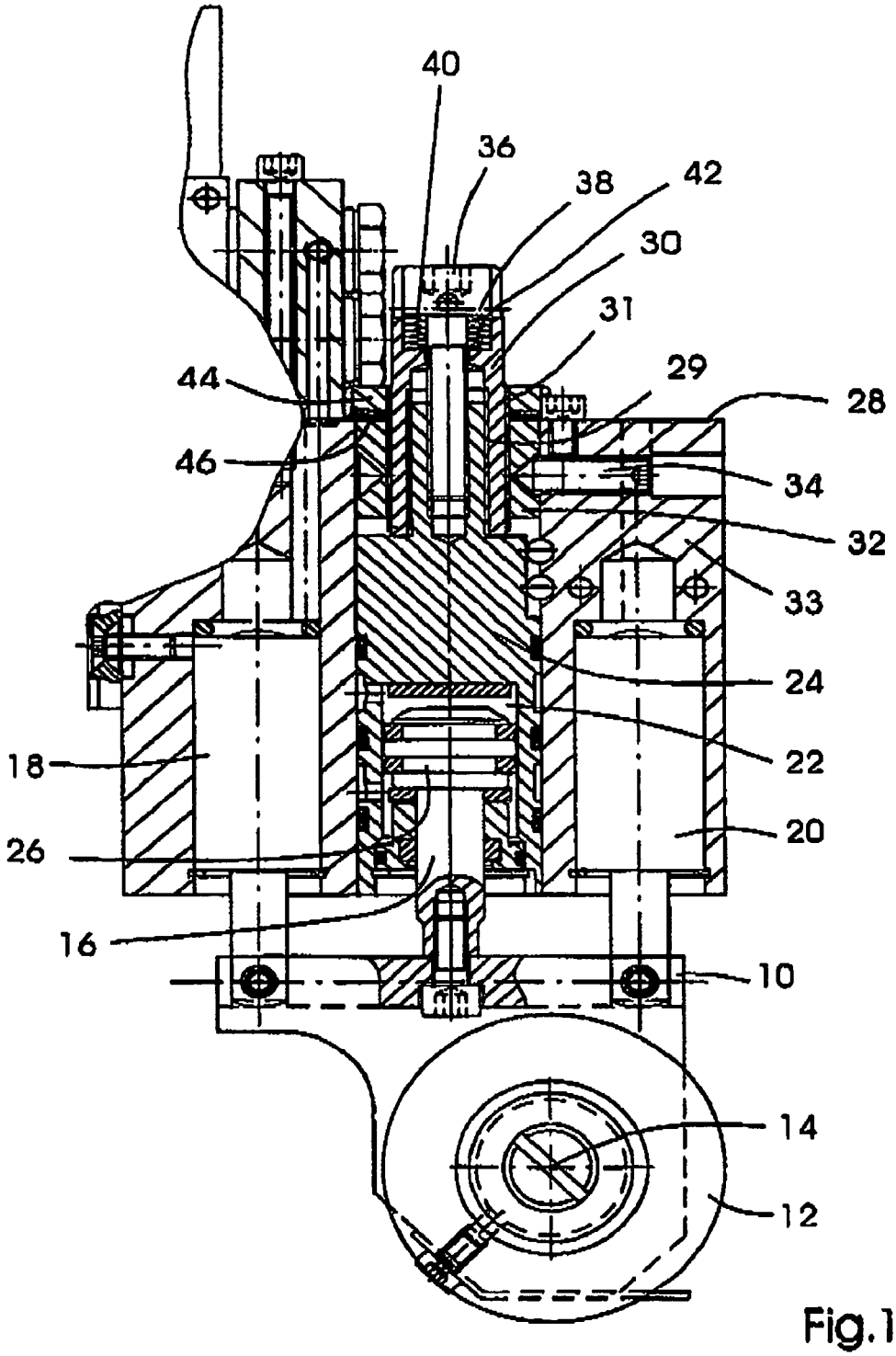
FIG. 1 is a schematic side view of a perforating apparatus according to the invention.

Referring now to the figures of the drawing in detail and first, particularly, to FIG. 1 thereof, there is seen a perforating apparatus according to the invention. The apparatus has a holder 10 to which a perforating blade 12 can be fastened to an axle 14 in a rotatable manner. The holder 10 is fastened to a piston rod 16, so that it is moved along with the piston rod 16 during a movement of the latter. For rectilinear guidance of movement, guide bushes 18 and 20 are provided on both sides. The guide bushes 18 and 20 ensure a rectilinear sequence of movement and prevent a rotation of the holder 10 about the axis of the piston rod 16.

The piston rod 16 and consequently the perforating blade are moved downward by pressure, in particular air pressure, being admitted to an air space 22, while the piston unit 24 is fixed in position. The resulting pressure is transmitted to the perforating piston 26, as a result of which the latter is moved downward.

To set an exact initial position of the cutting or perforating wheel 12, the "zero position" of the piston unit 24 is set relative to a housing edge 28 of the perforating apparatus. A positioning device 30 is provided in order to set the zero position of the piston unit 24. The positioning device acts on the initial position of the piston unit 24. The positioning device 30 is advantageously formed with an external thread 31 and an internal thread 29, the leads of which are different. The device may, in particular, be designed as a differential screw. In the embodiment described herein, the differential screw has an external thread 31 and an internal thread 29. The external thread 31 meshes with a separate nut 32, whereas the internal thread 29 is directly connected to a corresponding thread 47 (see FIG. 2*a*) of the piston/cylinder unit 24. The external thread 31 of the differential screw 30 has a different lead, e.g. a larger lead, than its internal thread 29. For example, a thread of 1.25 mm lead may be provided for the external thread 31, whereas the internal thread 29 has a lead of 1 mm. Lead is conventionally defined as the axial displacement of the threaded device upon being rotated by one revolution.

When the differential screw 30 is being unscrewed, it rotates upward in accordance with the lead of the external thread 31 so as to react with the nut 32, that is, for example, by 1.25 mm per revolution. At the same time, by the turning of the differential screw 30, the piston unit 24 is moved downward in accordance with the internal thread 29 of the differential screw 30, that is, for example, by 1 mm per revolution. Since the nut 32 is connected to the housing 33 in a rotationally locked manner via a pin 34, the turning of the differential screw upward results in a combined movement of the housing upward and of the piston unit 24 downward. The relative distance which the piston unit 24 covers relative to the housing surface 28 corresponds, per turn, to the difference between the leads of the external thread 31 and the internal thread 29. An external thread of 1.25 mm trim and an internal thread of 1 mm correspondingly result in a relative distance of 0.26 mm during a complete turn of the differential screw 30, so that fine positioning of the piston with an accuracy of 0.25 mm per turn can be ensured.

In an especially preferred embodiment, a bore into which a screw 36 can be screwed is provided in both the differential screw 30 and the piston unit 24. After being screwed into the bore, the screw 36 is secured against rotation with a pin 38. Furthermore, a disk spring assembly 40 is provided between the head of the screw 36 and a supporting point 42 lying in the interior of the differential screw. The screw 36 and the disk spring assembly 40 eliminate any thread backlash between the differential screw 30 and the piston unit 24.

When the differential screw 30 is being turned, the screw 36 is also turned with it, since the latter is secured to the differential screw by means of the pin 38. A self-locking effect which secures the differential screw 30 in the respectively desired position is accordingly achieved by the additional provision of the disk spring assembly 40.

Especially advantageous with this embodiment is the fact that the setting of the zero point of the piston unit can also be carried out on running machines and any necessary corrections can still be carried out when the machine is running.

The elimination of the thread backlash and also the self-locking of the differential screw by a combination of the screw 36 and the provision of a spring mechanism, such as the disk spring assembly 40 for example, considerably increases the durability of the fine setting. In addition to the elimination of the thread backlash between the differential screw 30 and the piston unit 24, it is also advantageous to eliminate the thread backlash between the differential screw 30 and the nut 32. For this purpose, a setting nut 44 lying above the nut 32 is provided, and this setting nut 44 acts on the nut 32 via a spring mechanism, in particular a corrugated spring assembly 46, and thus essentially prevents the occurrence of thread backlash between the external thread 31 of the differential screw 30 and the nut 32.

Figure 2A:
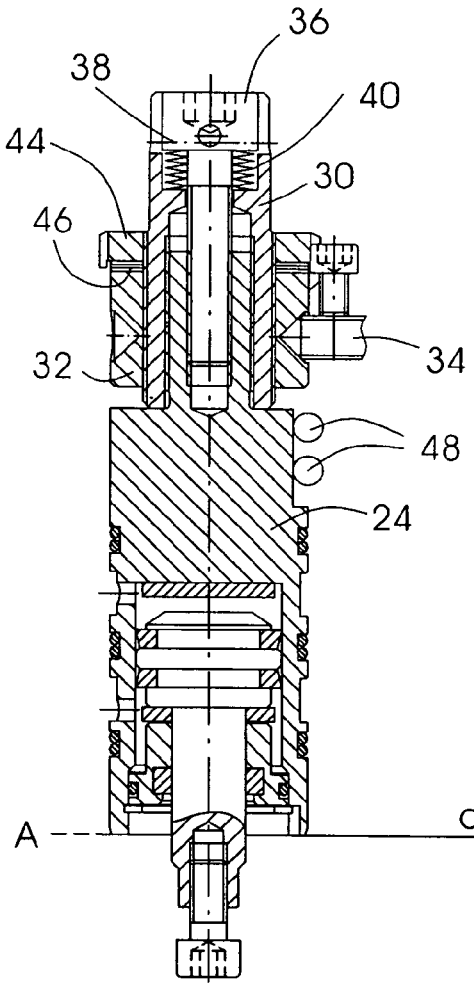
FIGS. 2*a* and 2*b* are sectional side views illustrating two positions of the perforating apparatus.
Figure 2B:
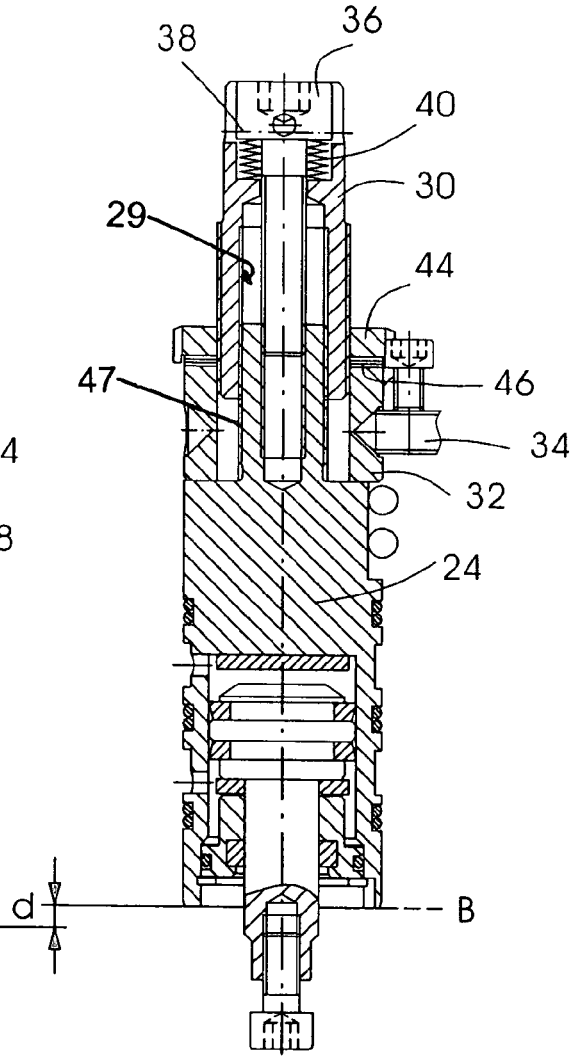

The perforating apparatus is shown in two different positions A and B in FIGS. 2*a* and 2*b*, respectively. The positioning is effected by the setting device according to the invention. In FIG. 2*a*, the differential screw 30 together with the screw 36, which is rotationally locked by the pin 38, and the disk spring assembly 40 is screwed into the piston unit

24. The piston unit 24 is locked against rotation by two pins 48. The lower end of the piston unit 24 is put into the position A by the differential screw 30 being screwed in. When the differential screw 30 is unscrewed, it moves upward relative to the nut 32 in accordance with the lead of the external thread of the differential screw 30. At the same time, the piston unit 24 moves downward relative to the differential screw 30 in accordance with the internal thread 29 of the differential screw 30, so that the resulting overall movement is obtained from the difference in the leads between the outer and inner threads. After the differential screw 30 has been unscrewed into the position shown in FIG. 2*b*, a resulting position B of that end of the piston unit 24 which faces the holder (not shown) is obtained on account of the two movements in opposite directions. In this way, the initial position of the piston unit 24 can be exactly set within the range d, so that the perforating device can be easily set to the respectively required perforating depth, even during operation.

We claim:

1. A perforating apparatus, Comprising:

a perforating tool;

a holder carrying said perforating tool;

a piston attached to said holder;

a cylinder configured for linearly guiding and actuating said piston;

a housing carrying said cylinder;

a threaded positioner having coaxial screw gearings with different leads, a first thread having a lead disposed on said cylinder coaxially with respect to said screw gearings, a threaded element having an internal thread and an external thread, said internal thread mating with said first thread, and a second thread having a different lead than said first thread being disposed at said housing and mating with said external thread of said threaded element, said threaded positioner meshing with said housing and said cylinder and configured for positioning said cylinder at different working levels with respect to said housing.

2. The perforating apparatus according to claim 1, wherein said threaded positioner includes a differential screw assembly.

3. The perforating apparatus according to claim 2, wherein said differential screw assembly is operatively connected to said housing and said cylinder.

4. The perforating apparatus according to claim 1, which further comprises elastic elements disposed to avoid backlash between said cylinder and said threaded element.

5. The perforating apparatus according to claim 1, which further comprises further elastic elements disposed to avoid a backlash between said threaded element and said housing.

* * * * *